US007735562B2

(12) United States Patent
Bennett et al.

(10) Patent No.: US 7,735,562 B2
(45) Date of Patent: Jun. 15, 2010

(54) TIEBACK SEAL SYSTEM AND METHOD

(75) Inventors: Rodney D. Bennett, Houston, TX (US); Sidney K. Smith, Conroe, TX (US); Jamie L. Imhoff, Houston, TX (US); James M. Fraser, III, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/734,448

(22) Filed: Apr. 12, 2007

(65) Prior Publication Data

US 2008/0251256 A1 Oct. 16, 2008

(51) Int. Cl.
*E21B 33/035* (2006.01)

(52) U.S. Cl. ..... 166/345; 166/339; 166/85.3; 166/82.1

(58) Field of Classification Search ..... 166/345, 166/338, 339, 343, 344, 85.3
See application file for complete search history.

(56) References Cited

U.S. PATENT DOCUMENTS

| | | | | |
|---|---|---|---|---|
| 2,683,928 | A | 8/1954 | Carson | |
| 3,054,450 | A | 9/1962 | Baker | |
| 3,112,796 | A | 12/1963 | Myers | |
| 3,136,365 | A | 6/1964 | Carter et al. | |
| 3,142,338 | A | 7/1964 | Brown | |
| 3,189,096 | A | 6/1965 | Phenix | |
| 3,256,437 | A | 6/1966 | Muse | |
| 3,282,342 | A | 11/1966 | Mott | |
| 3,289,766 | A | 12/1966 | Bigelow | |
| 3,361,209 | A | 1/1968 | Edwards, Jr. | |
| 3,456,723 | A | 7/1969 | Current et al. | |
| 3,678,998 | A | 7/1972 | Cockrell et al. | |
| 3,976,133 | A | 8/1976 | Allen | |
| 4,044,826 | A | 8/1977 | Crowe | |
| 4,176,715 | A | 12/1979 | Bigleow et al. | |
| 4,216,827 | A | 8/1980 | Crowe | |
| 4,263,968 | A | 4/1981 | Garner, Jr. | |
| 4,285,400 | A | 8/1981 | Mullins | |
| 4,311,195 | A | 1/1982 | Mullins | |
| 4,482,086 | A | 11/1984 | Wagner et al. | |
| 4,506,736 | A | 3/1985 | Evans | |
| 4,540,053 | A * | 9/1985 | Baugh et al. | 166/348 |
| 4,719,971 | A * | 1/1988 | Owens | 166/191 |
| 4,751,965 | A * | 6/1988 | Cassity | 166/182 |
| 4,791,992 | A * | 12/1988 | Greenlee et al. | 166/387 |
| 4,815,770 | A * | 3/1989 | Hyne et al. | 285/123.12 |

(Continued)

OTHER PUBLICATIONS

APEX TM Big Bore Completion Solutions, [online]; [retrieved on Nov. 3, 2006]; retrieved from the Internet http://www.bakerhughesdirect.com/cgi-bin/bot/resources/ExternalFileHandler.jsp?BV_SessionID=@@@@0932326691.11625.

*Primary Examiner*—Thomas A Beach
*Assistant Examiner*—Matthew R Buck
(74) *Attorney, Agent, or Firm*—Cantor Colburn LLP

(57) ABSTRACT

Disclosed herein is a method of sealing a tieback to a tubular. The method includes, positioning a metal deformable member of the tieback within a tubular and contacting the tubular with a sleeve of the tieback. Moving the sleeve in a first axial direction thereby contacting and radially deforming a first portion of the deformable member by axially compressing the deformable member and sealably engaging the tubular with the radially deformed first portion.

22 Claims, 4 Drawing Sheets

U.S. PATENT DOCUMENTS 4,834,175 A 5/1989 Ross et al.
5,025,864 A * 6/1991 Nobileau ..... 166/348
5,046,557 A 9/1991 Manderscheid
5,113,939 A 5/1992 Ross et al.
5,146,983 A 9/1992 Hromas et al.
5,146,994 A 9/1992 Pleasants et al.
5,211,226 A * 5/1993 Hendrickson et al. ..... 166/118
5,810,082 A * 9/1998 Jordan, Jr. ..... 166/120
5,988,276 A * 11/1999 Oneal ..... 166/118
6,032,958 A * 3/2000 Fowler ..... 277/337
6,425,444 B1 7/2002 Metcalfe et al.
6,431,282 B1 8/2002 Bosma et al.
6,530,574 B1 3/2003 Bailey et al.
6,896,049 B2 * 5/2005 Moyes ..... 166/82.1
2006/0011347 A1 * 1/2006 Reimert ..... 166/345

* cited by examiner

TIEBACK SEAL SYSTEM AND METHOD

BACKGROUND OF THE INVENTION

Tieback seals are commonly used to seal a tieback to a downhole tubular such as a liner. Seal integrity and durability are desirable characteristics for such seals, as once set, tieback seals are often kept in place for long periods of time, often multiple years.

Typical tieback seals incorporate elastomers at the seal interface. Caustic fluids, high temperatures and high pressures encountered downhole often precipitate degradation of elastomeric seals. Degraded seals can develop leaks that can be costly to an operation whether left in place or replaced. When left in place, the quality of a production stream can suffer. When replaced, the cost of equipment and labor as well as costs of lost production, during replacement down-time, will accumulate. Accordingly, there is a need in the art for highly durable tieback seals.

BRIEF DESCRIPTION OF THE INVENTION

Disclosed herein is a tieback seal system. The system includes, a tubular receptive of a tieback seal assembly. The tieback seal assembly includes, a body, a sleeve in radial alignment with the body, a ratcheting member, a shoulder within the tubular, and at least one deformable metal member in operable communication with the sleeve and the body. The operable communication is such that movement of the sleeve in a first axial direction causes deformation of at least one of the at least one deformable metal member and sealing with the tubular in response to being in a deformed position. The ratcheting member is engaged between the body and the sleeve such that the sleeve is movable in the first axial direction relative to the body and is not movable in a second axial direction that is opposite to the first axial direction. The shoulder is contactable with the sleeve such that contact of the sleeve and the shoulder causes axial motion of the sleeve relative to the body.

Further disclosed herein is a method of sealing a tieback to a tubular. The method includes, positioning a metal deformable member of the tieback within a tubular and contacting the tubular with a sleeve of the tieback. Moving the sleeve in a first axial direction thereby contacting and radially deforming a first portion of the deformable member by axially compressing the deformable member and sealably engaging the tubular with the radially deformed first portion.

Further disclosed herein is a method of sealing a tieback to a tubular. The method includes, positioning each of a plurality of metal radially deformable members of a tieback within a tubular, moving the tieback into functional contact with the tubular, actuating a sleeve of the tieback through the functional contact with the tubular and selectively deforming at least one of the plurality of metal radially deformable members with the actuation of the sleeve. The method further includes maintaining the plurality of metal radially deformable members in deformed positions with a ratcheting member.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
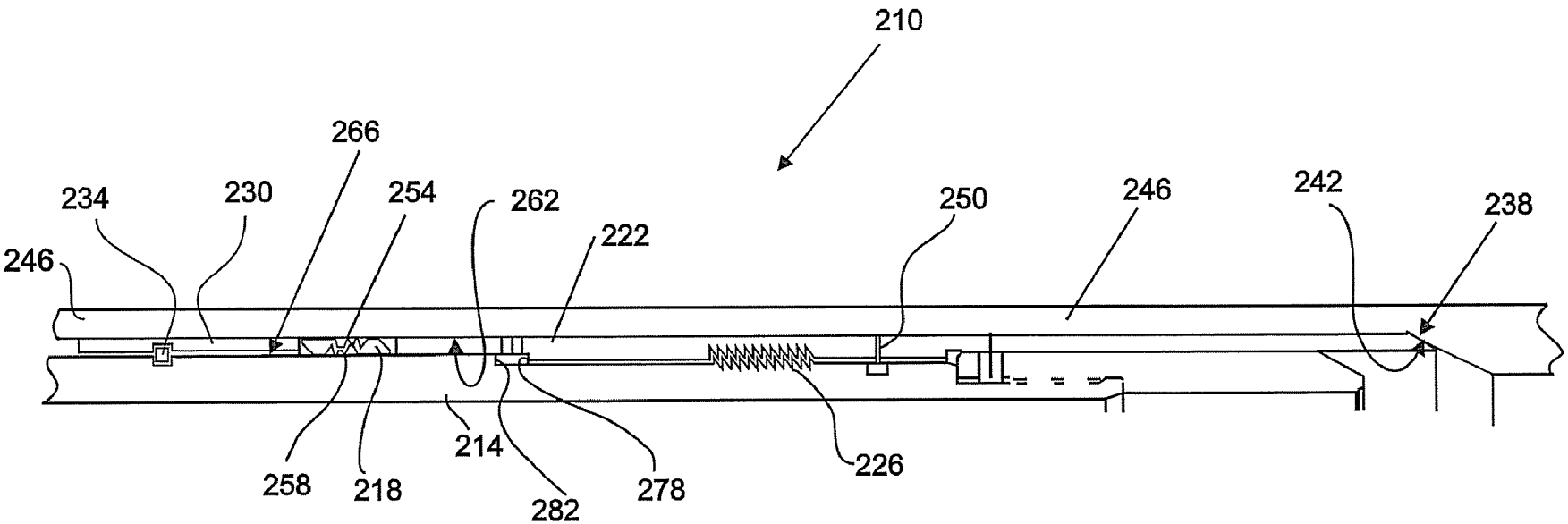
FIG. 1 depicts a partial cross sectional view of a tieback seal system disclosed herein.

Referring to FIG. 1, an embodiment of the tieback seal assembly 210 is illustrated. The tieback seal assembly 210 includes a body 214, a deformable member 218, a sleeve 222, a ratcheting member 226 and a collar 230. The deformable member 218 is axially compressed between the collar 230, which is fixedly attached to the body 214 by a snap ring 234, and the sleeve 222 that is axially movable relative to the body 214. The deformable member 218 will be described in greater detail with reference to FIG. 2.

Movement of the sleeve 222, relative to the body 214, occurs when an end surface 238 of the sleeve 222 contacts a shoulder 242 of a downhole tubular with which the tieback assembly will seal herein referred to as liner 246. Downhole movement of the tieback assembly 210 into the stationary liner 246 causes the end surface 238 to contact the shoulder 242. The uphole directed force on the sleeve 222 increases until an optional shear screw 250, axially locking the sleeve 222 to the body 214 is sheared, after which the sleeve 222 is able to stop moving in a downhole direction with the body 214.

As the tieback seal assembly 210 continues moving in a downhole direction the body 214, collar 230 and deformable member 218 continue to move downhole while the sleeve 218 remains stationary due to contact with the shoulder 238 of the liner 246. Continued movement causes the deformable member 218 to compress axially between the sleeve 222 and the collar 230. In this embodiment, the axial compression of the deformable member 218 causes a first portion 254 to extend radially outwardly and a second portion 258 to extend radially inwardly. The radially outwardly deformation of the first portion 254 causes the first portion 254 to sealably engage with an inner surface 262 of the liner 246. Similarly, the radially inwardly deformation of the second portion 258 causes the second portion 258 to sealably engage with an outer surface 266 of the body 214. Thus the deformable member 218 when in a deformed configuration is sealable engaged with both the body 214 and the liner 246 simultaneously. Maintaining the deformable member 218 in axial compression can help assure that the sealing function performed by the deformable member 218 is maintained. The ratcheting member 226 is, therefore, functionally engaged with the body 214 and the sleeve 222 to allow movement of the sleeve 222 in one direction relative to the body 214 while preventing movement of the sleeve 222 in the opposite direction. A review of the deformable member 218 is described in more detail below.

Figure 2:
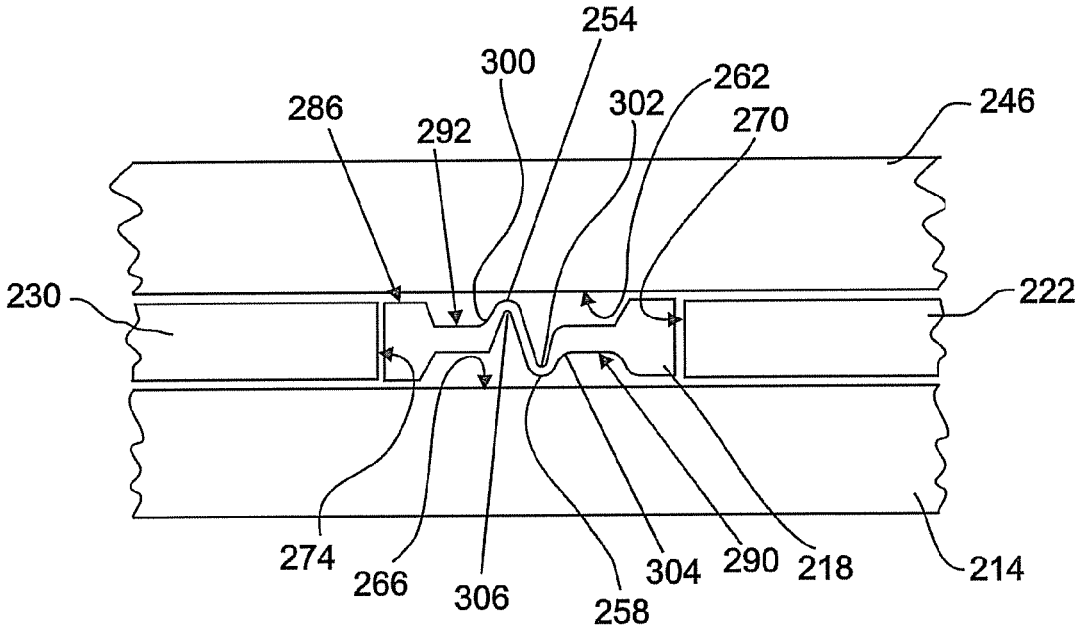
FIG. 2 depicts a magnified partial cross sectional view of a deformable member of FIG. 1.

Referring to FIG. 2, the deformable member 218 is illustrated in magnified partial cross section. The deformable member 218 is positioned radially between members to which it will be sealed, which in this embodiment are the liner 246 and the body 214. The deformable member 218 sealably engages with an inner surface 262 of the liner 246 and an outer surface 266 of the body 214 simultaneously. The first portion 254 and the second portion 258 of the deformable member 218 deform in response to an axial compression of the deformable member 218. The deformable member 218 is axially compressed between an end 270 of the sleeve 222 and an end 274 of the collar 230. Axial compression of the deformable member 218 can be controlled by limiting the movable distance of the sleeve 222 with a stop surface 278 contacting a stop surface 282 on the body 214, as best shown in FIG. 1. The axial compression of the deformable member 218 causes the first portion 254 to extend radially outwardly a dimension greater than the greatest radially protruding portion of the deformable member 218 in a non-deformed configuration. Similarly, The axial compression of the deformable member 218 causes the second portion 258 to extend radially inwardly a dimension greater than the smallest radially protruding portion of the deformable member 218 in a non-deformed configuration.

Reconfigurability of the deformable member 218 between the non-deformed configuration and the deformed configuration is effected by and is enabled by the construction thereof. The deformable member 218 is formed from a tubular member 286 that has four lines of weakness, specifically located both axially of the tubular member 286 and with respect to an inside surface 290 and an outside surface 292 of the tubular member 286. In one embodiment, a first line of weakness 300 and a second line of weakness 302 are defined in this embodiment by diametrical grooves formed in the outside surface 292 of the tubular member 286. A third line of weakness 304 and a fourth line of weakness 306 are defined in this embodiment by a diametrical grooves formed in the inside surface 290 of the tubular member 286. The four lines of weakness 300, 302, 304, 306 each encourage local deformation of the tubular member 286 in a radial direction that tends to cause the groove to close. It will be appreciated that in embodiments where the line of weakness is defined by other than a groove, the radial direction of movement will be the same but since there is no groove, there is no "close of the groove." Rather, in such an embodiment, the material that defines a line of weakness will flow or otherwise allow radial movement in the direction indicated. The four lines of weakness 300, 302, 304, 306 together encourage deformation of the tubular member 286 in a manner that creates a feature such as the deformed configuration. The feature is created, then, upon the application of an axially directed mechanical compression of the tubular member 286 such that the deformed configuration is formed as the tubular member 286 is compressed to a shorter overall length.

Figure 3:
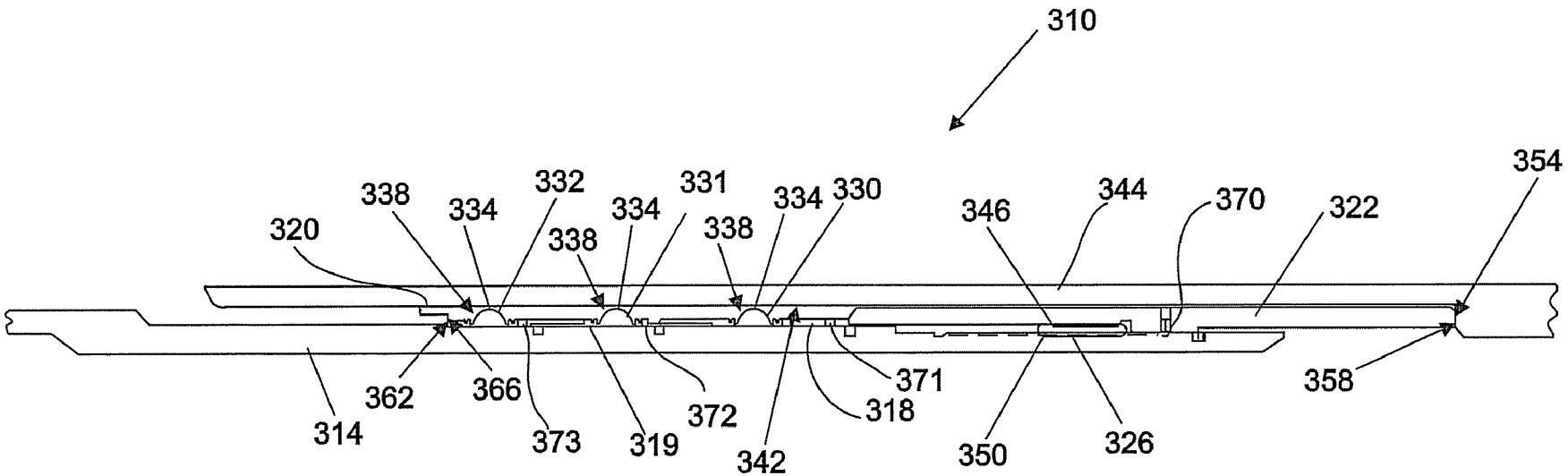
FIG. 3 depicts a partial cross sectional view of an alternate tieback seal disclosed herein having multiple deformable members that are shown deformed.
Figure 4:
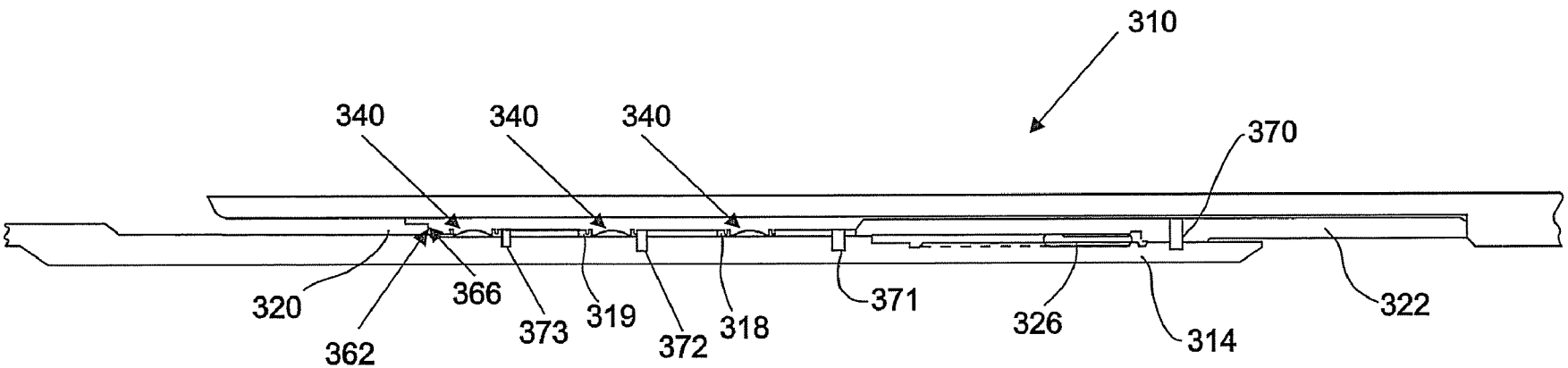
FIG. 4 depicts a partial cross sectional view of the tieback seal of FIG. 3 with the multiple deformable members shown non-deformed.

Referring to FIGS. 3 and 4, an alternate embodiment of the tieback seal assembly 310 is illustrated. The tieback seal assembly 310 includes a body 314, three deformable members 318, 319, and 320, a sleeve 322 and a ratcheting member 326. The deformable members 318, 319, 320 and sleeve 322 are in radial alignment with the body 314. A first deformable portion 330 of the first deformable member 318 deforms, in this embodiment, in response to all axial compression thereof (a description of the deformable member 318 is provided with reference to FIG. 5 below). Similarly, a second deformable portion 331 of the second deformable member 319 and a third deformable portion 332 of the third deformable member 320, deform in response to axial compressions thereof. Axial movement of the sleeve 322 relative to the body 314 can provide an axially compressive force to the deformable members 318, 319, 320. Each of the deformable members 318, 319, 320 includes a contact portion 334 on each of their respective deformable portions 330, 331, 332 that is radially deformed in deformed positions 338 (as shown in FIG. 3). When the deformable members 318, 319, 320 are in deformed positions 338 the contact portion 334 is radially extended to a radial dimension that is greater than the largest radial dimension of the deformable members 318, 319, 320 when the deformable members 318, 319, 320 are in non-deformed positions 340 (as shown in FIG. 4). The contact portion 334 on each of the deformable portions 330, 331, 332 makes sealable contact with an inner surface 342 of a liner 344, for example, within which the tieback seal assembly 310 is positioned.

The ratcheting member 326 has a movable portion 346, attached to the sleeve 322, and a stationary portion 350, attached to the body 314. The movable portion 346 moves with the sleeve 322 in an uphole direction relative to the body 314 in this embodiment (although other embodiments could have the sleeve 322 move in a downhole direction relative to the body 314). Movement of the sleeve 322 causes the deformable members 318, 319, 320 to deform from the non-deformed positions 340 to the deformed positions 338. It should be noted that in this embodiment the body 314 is actually moving in a downhole direction and the sleeve 322 is stationary due to contact of an end 354 of the sleeve 322 with a shoulder 358 on the stationary liner 344. The ratcheting member 326 allows movement of the sleeve 322 relative to the body 314 in one direction while not permitting relative movement in the opposite direction. In so doing, the ratcheting member 326 locks the deformable members 318, 319, 320 in the deformed position 338. The deformable members 318, 319, 320 are prevented from moving relative to the body 314 by a shoulder 362 on the third deformable member 320 that engages with a stop surface 366 on the body 314.

The three deformable members 318, 319, 320 are structurally similar to one another and are described in detail with reference to FIG. 5. The three deformable members 318, 319, 320 are operationally coupled together. That is, deformable member 318 is in operational communication with the deformable member 319, which is in operational communication with the deformable member 320. Thus all three deformable members 318, 319, 320 are loaded simultaneously by the sleeve 322 and as such will actuate at a same force if they are designed and built to do so. Thus, control of actuation of the three deformable members 318, 319, 320 can be controlled by the design and construction of the three deformable members 318, 319, 320 in relation to one another. Thinning the material of the three deformable members 318, 319, 320 so that they deform at different force values, for example, would allow an operator to independently control the deformation of each of the three deformable members 318, 319, 320 at will. Such control would also allow an operator to actuate the deformable members 318, 319, 320 sequentially or substantially simultaneously.

Alternatively, sequential control of actuation of the three deformable members 318, 319, 320 can be by incorporating a series of force failing members, disclosed herein as shear screws, between components. For example, four shear screws 370, 371, 372, and 373 (shown intact in FIG. 4 and shown as sheared in FIG. 3) could be incorporated as follows. A first shear screw 370 between the sleeve 322 and the body 314 can control loading of the ratcheting member 326. A second shear screw 371 between the first deformable member 318 and the body 314 can control loading of the first deformable member 318. A third shear screw 372 between the second deformable member 319 and the body 314 can control loading of the second deformable member 319. And a fourth shear screw 373 between the third deformable member 320 and the body 314 can control loading of the third deformable member 320. It should be noted that axial clearance between the sleeve 322 and the first deformable member 318 would be necessary to allow for the first shear screw 370 to shear without the second shear screw 371 shearing at the same time. Through the foregoing construction it is possible to independently control at what force each of the deformable members 318, 319, 320 are loaded. As such, any one of the three deformable members 318, 319, 320 could be deformed at one point in time by applying the appropriate load and then at a latter time any of the remaining deformable members 318, 319, 320 could be deformed, and so on until all of the deformable members 318, 319, 320 have been deformed.

Figure 5:
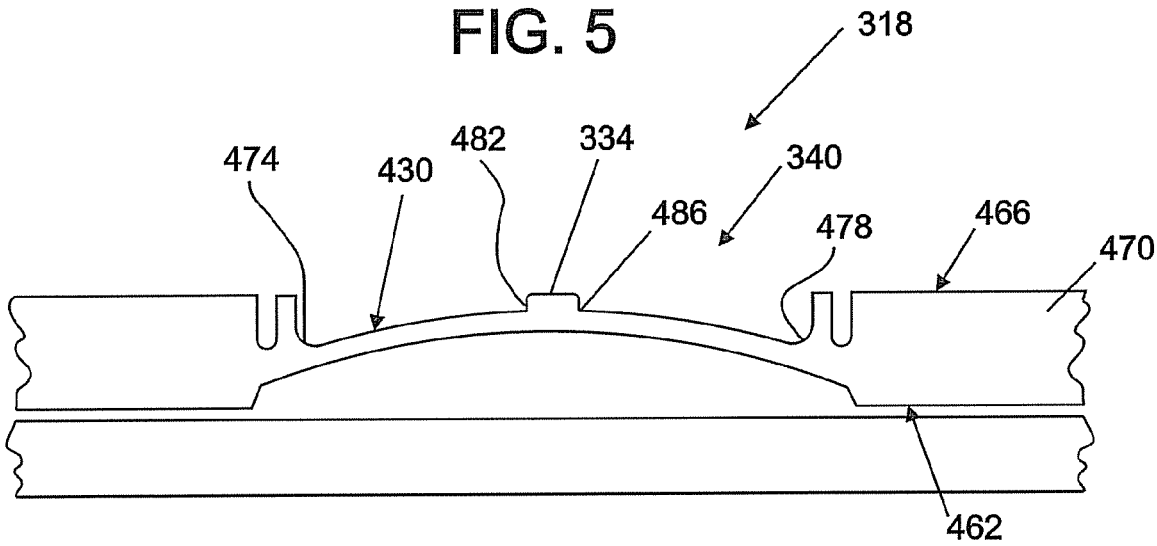
FIG. 5 depicts a magnified cross sectional view of a deformable member of FIG. 3.

Referring to FIG. 5, any one of the three deformable members 318, 319, 320 is deformable from the non-deformed position 340 to the deformed position 338 (FIG. 3) due to the construction thereof. The first deformable member 318 will be described herein as an example only and it should be understood that all of the deformable members 318, 319, 320 react similarly. A deformable portion 430 is formed from a section of the deformable member 318 that has four lines of weakness, specifically located both axially of the first deformable member 318 and with respect to an inside surface 462 and an outside surface 466 of a wall 470 of the deformable member 318. In one embodiment, a first line of weakness 474 and a second line of weakness 478 are defined by a change in thickness of the wall 470. A third line of weakness 482 and a fourth line of weakness 486 are defined by a geometrical location of changes in thickness of the deformable portion 430 on either side of the contact portion 334. The four lines of weakness 474, 478, 482 and 486 each encourage local deformation of the first deformable member 318 to deform radially outwardly. It should be appreciated that in embodiments where the line of weakness is defined by other than a change in thickness, the radial direction of movement may be the same but caused by the alternate lines of weakness construction. Further, in such an embodiment, the material that defines a line of weakness will flow or otherwise allow radial movement in the direction indicated. The four lines of weakness 474, 478, 482 and 486 together encourage deformation of the first deformable member 318 in a manner that creates a feature such as the deformable position 338 of the first deformable member 318. The feature is created, then, upon the application of an axially directed mechanical compression of the first deformable member 318 such that the deformable portion 430 is actuated as the first deformable member 318 is compressed to a shorter overall length. Other mechanisms can alternatively be employed to reposition the first deformable member 318 between the non-deformed position 340 and the deformed position 338. For example, the first deformable member 318 may be repositioned to the deformed position by diametrically pressurizing the first deformable member 318 about the inside surface 462 in the deformable portion 430. Embodiments of the first deformable member 318 can be made of metal, which may have improved resistance to degradation due to exposure to high temperatures, high pressures and caustic fluids often encountered in downhole environments, than conventional sealing elements. Additionally, a seal made with a metal deformable member may have an advantage of increased resistance to swabbing off. Once the first deformable member 318 is deformed due to its length being shortened the ratcheting member 326 can maintain the first deformable member 318 in the shortened condition.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A tieback seal system, comprising:

a tubular receptive of a tieback seal assembly, the tieback seal assembly comprising:

a body;

a sleeve in radial alignment with the body;

a ratcheting member engaged between the body and the sleeve such that the sleeve is movable in a first axial direction relative to the body and is not movable in a second axial direction that is opposite to the first axial direction;

a shoulder on the tubular, the shoulder being contactable with the sleeve such that contact of the sleeve and the shoulder causes axial motion of the sleeve relative to the body; and at least one deformable metal member in operable communication with the sleeve and the body such that movement of the sleeve in the first axial direction causes deformation of at least one of the at least one deformable metal member and sealing with the tubular in response to being in a deformed position.

2. The tieback seal system of claim 1, further comprising a surface within the tubular, the surface being sealable with the at least one deformable member.

3. The tieback seal system of claim 1, the at least one deformable member further comprising:

at least one circumferential line of weakness near an outside surface thereof; and at least one circumferential line of weakness near an inside surface thereof.

4. The tieback seal system of claim 3, wherein the circumferential lines of weakness are grooves.

5. The tieback seal system of claim 3, wherein the circumferential lines of weakness are changes in thickness of walls of the deformable member.

6. The tieback seal system of claim 1, wherein a portion of the at least one deformable member when in the deformed position extends radially outwardly a greater dimension than the at least one deformable member extends when in a non-deformed position.

7. The tieback seal system of claim 1, wherein a portion of the at least one deformable member when in the deformed position extends radially inwardly a greater dimension than the at least one deformable member extends when in a non-deformed position.

8. The tieback seal system of claim 1, wherein portions of the at least one deformable member when in the deformed position extend both radially inwardly and radially outwardly greater dimensions than the at least one deformable member extends when in a non-deformed position.

9. The tieback seal system of claim 1, wherein the at least one deformable member is sealably engagable with the body when in the deformed position.

10. The tieback seal system of claim 1, wherein the ratcheting member further comprises:

at least one first ratchet portion attached to the sleeve with a plurality of teeth; and at least one second ratchet portion attached to the body with a plurality of teeth and engagable with the teeth of the at least one first ratchet portion such that the sleeve can move in the first axial direction and not in the second axial direction.

11. The tieback seal system of claim 1, wherein the at least one deformable member includes a plurality of deformable members and actuation of the plurality of deformable members is selectively controllable.

12. The tieback seal system of claim 11, wherein the selective controllability is due to selection of design parameters for each of the plurality of deformable members to thereby control an axial force required to deform each of the plurality of deformable members.

13. The tieback seal system of claim 11, further comprising a force failing member in operable communication with each deformable member such that each deformable member has a specific force failing member associated therewith that determines the force at which the associated deformable member is loaded.

14. The tieback seal system of claim 13, wherein the plurality of force failing members are shear screws.

15. A method of sealing a tieback to a tubular, comprising:

positioning at least one metal deformable member of the tieback within a tubular;

contacting the tubular with a sleeve of the tieback, the sleeve being in operable communication with the at least one deformable member;

moving the sleeve in a first axial direction relative to a body of the tieback;

radially deforming a first portion of the at least one deformable member by axially compressing the at least one deformable member;

sealably engaging the tubular with the first radially deformed portion; and maintaining the at least one metal deformable member in a deformed position with a ratcheting member engaged between the body and the sleeve.

16. The method of sealing a tieback to a tubular of claim 15, wherein the maintaining the at least one metal deformable member in the deformed position further comprises engaging the ratcheting member in operable communication with the sleeve and the body to allow movement of the sleeve in the first axial direction while preventing movement of the sleeve in a second axial direction that is opposite that of the first axial direction.

17. The method of sealing a tieback to a tubular of claim 15, further comprising radially deforming the first portion of the at least one deformable member radially outwardly in response to axial compression thereof.

18. The method of sealing a tieback to a tubular of claim 15, further comprising radially deforming a second portion of the at least one deformable member in a radial direction opposite to that of the first radially deformed portion in response to axial compression thereof; and sealably engaging the second radially deformed portion with the body.

19. The method of sealing a tieback to a tubular of claim 15, further comprising positioning lines of weakness at the at least one deformable member to control the deformation of the at least one deformable member.

20. A method of sealing a tieback to a tubular, comprising:

positioning each of a plurality of metal radially deformable members of a tieback within a tubular;

moving the tieback into functional contact with the tubular;

actuating a sleeve of the tieback in a first axial direction relative to a body of the tieback through the functional contact with the tubular;

selectively deforming at least one of the plurality of metal radially deformable members with the actuation of the sleeve; and maintaining the plurality of metal radially deformable members in deformed positions with a ratcheting member engaged between the body and the sleeve.

21. The method of sealing a tieback to a tubular of claim 20, further comprising selectively setting a force required to deform each of the plurality of metal deformable members by design control of physical parameters of each of the plurality of metal deformable members.

22. The method of sealing a tieback to a tubular of claim 20, further comprising selectively setting a force required to deform each of the plurality of metal deformable members by positioning a force failing member in functional communication with each of the plurality of metal deformable members.

* * * * *